United States Patent [19]

White

[11] Patent Number: 4,624,516

[45] Date of Patent: Nov. 25, 1986

[54] ELECTRICAL JUNCTION HOUSINGS

[75] Inventor: Rowland S. White, Canterbury, England

[73] Assignee: Allied Corporation, Morris Township, Morris County, N.J.

[21] Appl. No.: 716,903

[22] Filed: Mar. 28, 1985

[30] Foreign Application Priority Data

Mar. 29, 1984 [GB] United Kingdom ..... 8408097

[51] Int. Cl.[4] ..... H01R 13/44

[52] U.S. Cl. ..... 339/40; 339/36

[58] Field of Search ..... 339/40, 42, 36

[56] References Cited

U.S. PATENT DOCUMENTS 4,461,523 7/1984 Ustin et al. ..... 339/42

FOREIGN PATENT DOCUMENTS 2256558 7/1975 France ..... 339/40
1375777 11/1974 United Kingdom .
1420177 1/1976 United Kingdom .
1490571 11/1977 United Kingdom .
1512307 6/1978 United Kingdom .
2068651 8/1981 United Kingdom .
2089146 6/1982 United Kingdom .
2113478 8/1983 United Kingdom .
2134723 8/1984 United Kingdom .

*Primary Examiner*—Gil Weidenfeld
*Assistant Examiner*—Paula Austin
*Attorney, Agent, or Firm*—Roger H. Criss

[57] ABSTRACT

A fascia assembly (10, 20) for an electrical junction housing comprises a fascia (20) with an aperture therein and a connection module (10) having resilient location means (14, 15, 17) adapted to co-operate with the edges of the aperture releasably to locate the module in the aperture with the module flush with the fascia. The module has a plug-receiving aperture (**12*a*) which is shuttered by a shutter (13**) on the module.

The connection module may carry any desired connector, for example, a socket for a telephone jack plug, and different modules can carry different connector types.

16 Claims, 12 Drawing Figures

ELECTRICAL JUNCTION HOUSINGS

BACKGROUND OF THE INVENTION

1. Field of the Invention

This invention relates to electrical junction housings and, more particularly, to a fascia assembly and a connection module for such housings.

2. Description of the Prior Art

Conventionally, certain items of electrical equipment such as telephones have been connected to fixed supply cabling by means of a closed junction box. The user of the equipment could not, therefore, move it from place to place. More recently, telephones have been equipped with jack plugs so that they can be unplugged by the user and moved, for example, from room to room in a house as required. A new type of junction box which includes a socket for the jack plugs has been developed and typically several of these boxes would be installed for each telephone in a house or office to allow the telephone to be used in as many different rooms as the user required. The rapid growth of computerised data bases and other electronic information systems which rely on the telecommunications network for the transmission of data etc., has led to a proliferation of different types of junction box capable of receiving inputs from a variety of different equipment.

It would be desirable to provide a standardized type of junction apparatus which would accept a variety of connecting inputs.

SUMMARY OF THE INVENTION

In accordance with this invention, there is provided a fascia assembly for an electrical junction housing which assembly comprises a fascia with an aperture therein and a connection module having a front plate carrying resilient location means adapted to cooperate with the edges of the aperture releasably to locate the module in the aperture, the fascia having a formation around the aperture against which the rear of the front plate bears such that the front face of the front plate is flush with the fascia.

Use of a fascia assembly according to the invention considerably simplifies the manufacture of junction housings such as junction boxes for telecommunications equipment since the rear portion of the box and the fascia may be manufactured as standard items irrespective of the use to which they are to be put whilst the connection modules which are also of standard size may be produced as blanks and then fitted with the desired connector or may be produced with the desired connector in situ. For example, in a house equipped with a line jack telephone, each junction box may be equipped with a connection module carrying a shuttered socket for the telephone jack plug. For applications in which more complex equipment is needed, the fascia plates may be provided with more than one aperture to receive the appropriate number of connection modules.

In further accordance with this invention, there is provided an electrical connection module for mounting in an opening in a housing member having a substantially rectangular front plate with resilient location means on the rear thereof adapted to cooperate with the edges of the opening releasably to locate the module in the opening, the front plate having a shuttered aperture with the shutter slidable on the rear of the front plate between open and closed positions.

Also in accordance with this invention, there is provided an electrical connection system, comprising a plurality of fascia members each having a substantially rectangular aperture therein of the same dimensions, and a plurality of connection modules each having the same peripheral dimension to fit the apertures, and the connection modules carrying different connector types.

The connection module has an aperture for receiving a plug. This aperture can be shuttered by a shutter carried on the connection module itself. The shutter slides on the rear of the front plate of the connection module between open and closed positions and is spring loaded to its closed position. The front plate of the connection module is thus preferably rectangular and sufficiently larger than the plug-receiving aperture to accommodate the shutter in its open position.

The connection modules may carry any desired connector, for example, a socket for a telephone answering machine, an isolation switch, a coaxial cable connector, a computer outlet (e.g. 25-way D connector). Each connection module may carry more than one connector. The construction, colour, dimensions and other features of the fascia assembly may be selected in accordance with relevant official standards. The fascia itself is preferably made of a plastics material such as polycarbonate. The fascia can however be made of metallic material such as brass to provide a decorative finish. In this case, the use of a demountable connection module carrying the electrical connector provides better insulation than if the connector was itself mounted on a brass fascia.

BRIEF DESCRIPTION OF THE DRAWINGS

FIGS. *7a* to *7e* schematically show front elevation views of several fascia assemblies according to the invention.

DESCRIPTION OF THE PREFERRED EMBODIMENTS

As pointed out above, this invention provides a fascia assembly which is provided with one or more apertures to receive the appropriate number of connection modules.

The connection module may be made of any desired material or materials provided that the location means is resilient. Indeed, the module may be made entirely from a resilient metallic or non-metallic material. Suitable non-metallic materials are plastic materials such as polycarbonate, nylon or acetal. Preferably, the connection module is produced from a plastic material as an integral moulding. The resilient location means may be at or adjacent to the edges of the module on the rear surface thereof. The resilient location means is preferably so constructed that the connection module may be located in the aperture in the fascia from the front so that the fascia need not necessarily be separated from the rear of the housing for the module to be connected to the power supply and to any circuitry in the housing.

Furthermore, if the connector itself should develop a fault or be damaged, it is only necessary to replace the connection module. This can lead to a considerable saving as compared with conventional junction housing arrangements if the fascia is made of an expensive material such as brass since this need not be replaced.

Figure 1:
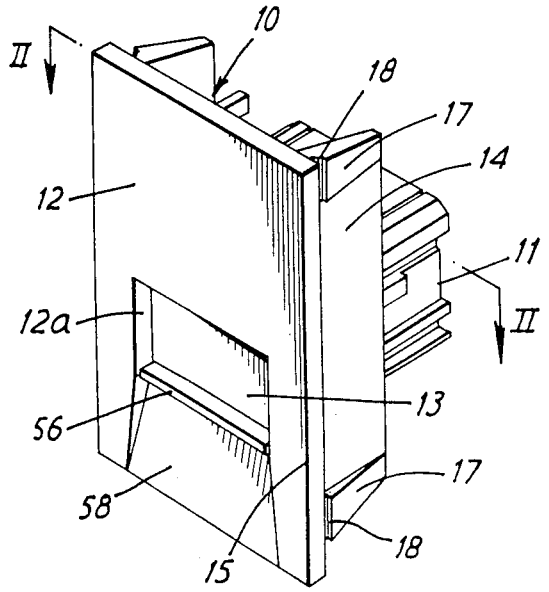
FIG. 1 shows a perspective view of a connection module for use in an electrical junction housing fascia assembly according the invention.

With reference to the drawings, the connection module 10 shown in FIG. 1 is made of polycarbonate and carries a socket 11 for a telephone jack plug (not shown). The module is rectangular in shape as seen from the front and has a front plate 12 and an opening 12*a* through which the jack plug may be inserted. The opening 12*a* is covered by a spring loaded shutter 13 which remains within the module even when retracted for insertion of the jack plug. Two parallel resilient flanges 14 (only one of which is visible in FIG. 1) are integrally moulded one along each of the long edges 15 of the module.

Figure 2:
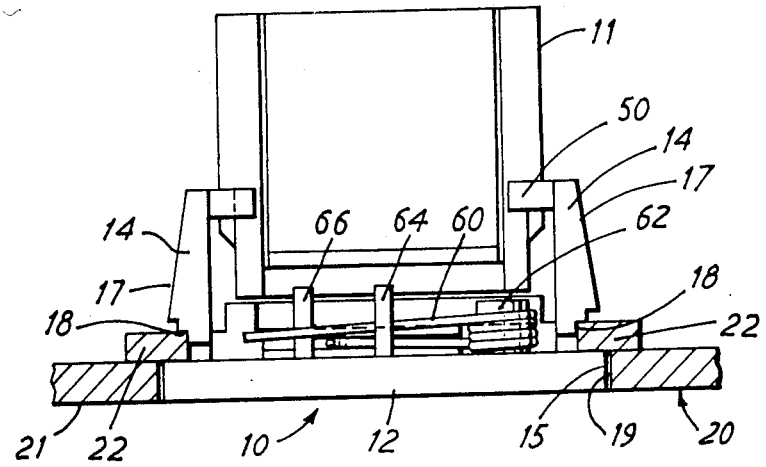
FIG. 2 shows a cross-section through the module of FIG. 1 inserted in a fascia taken on the line II—II on FIG. 1.

FIG. 2 shows a cross-section through the module of FIG. 1 taken on line II—II in FIG. 1 with the module in position in an aperture 19 in the fascia 20 (also shown in cross-section) of an electrical junction box. As may be seen from the drawings, the two flanges 14 are located inwardly of the respective edges 15 of the module. The flanges carry upper and lower sections 16 which are not direclty fixed to the front plate 12 but are free to flex slightly about the central section of the flange. The outer surface of the upper and lower end sections of each flange is provided with generally wedge-shaped projections 17 having grooved bases 18. The arrangement of the flanges 14, wedges 17 and adjacent edges 15 of the module constitute resilient location means adapted to co-operate with bearing plates 22 on the long edges of the aperture in the fascia 20 releasably to locate the module in the fascia.

Thus the module 10 can be mounted on the fascia 20 simply by hand pressure, and is pushed into the aperture 19 in the fascia from the front of the fascia. As the wedges 17 strike the sides of the aperture, the sections 16 are cammed inwardly and deflect to allow the module to move into the aperture, until the stepped section 18 engages the bearing plate 22 to retain the module in the aperture. Two steps are provided to accommodate two thicknesses of plate 22. In this way it is possible to have the front surface of the plate 12 flush with the fascia 21, thereby avoiding an unattractive dirty ring around the module which is difficult to clean, and enhancing the appearance of the unit.

The plates 22 can be integrally moulded with the rest of the module 10 comprising the front plate 12 and flanges 14.

The flanges 14 are also provided with socket-retaining lugs 50. The module shown in the drawings may be inserted into the aperture in the fascia from the front by a simple snap-in action. To this end, the lugs 50 extend along part of the length of the flange along the rear extremities thereof and are inwardly directed towards each other. Each lug 50 is provided with a stop 52 at the top end thereof and a detent 54 on the botton end thereof which is mounted on the flexible lower section 16 of the flange 14. The socket 11 is provided with a groove on each side into which the lugs 50 engage so that the socket can be slid onto the module 10 upwardly until it hits the stops 52, where it will be retained by detents 54 closing beneath it.

Figure 5:
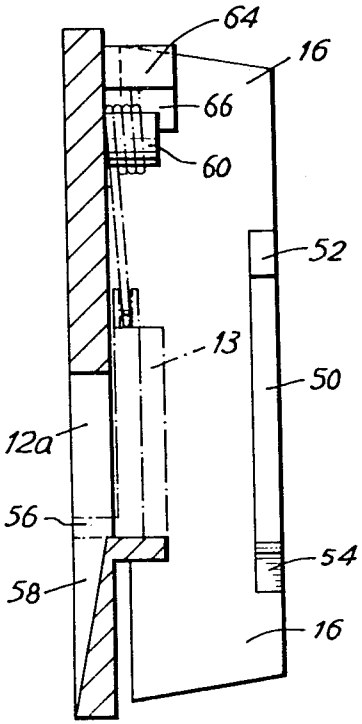
FIG. 5 is a side sectional view taken on the line V—V in FIG. 3 omitting the spring and showing the shutter in chain-dotted lines.
Figure 4:
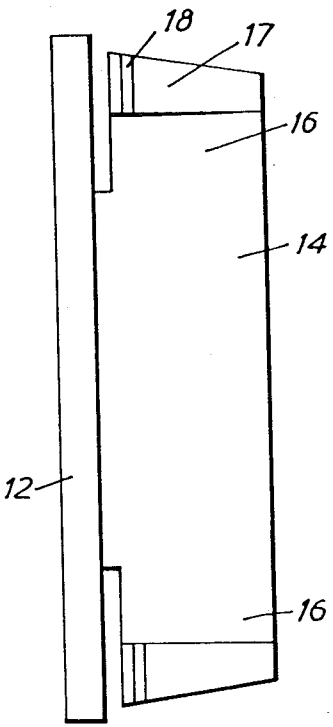
FIG. 4 is a side view of the front plate and flange only taken on the arrow IV in FIG. 3.
Figure 3:
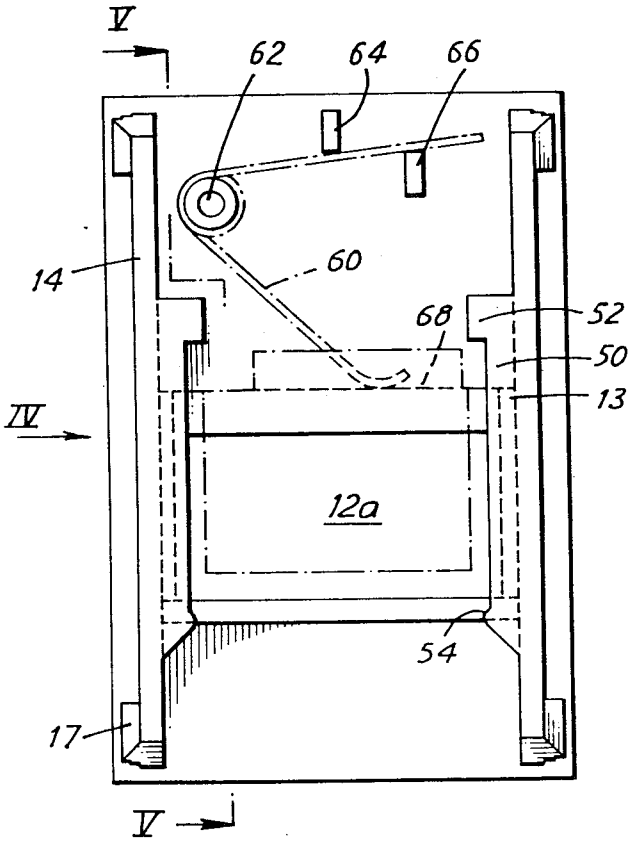
FIG. 3 is a rear view of the module of FIG. 1 with the socket removed and the shutter shown in chain-dotted lines in its closed position.
Figure 6:
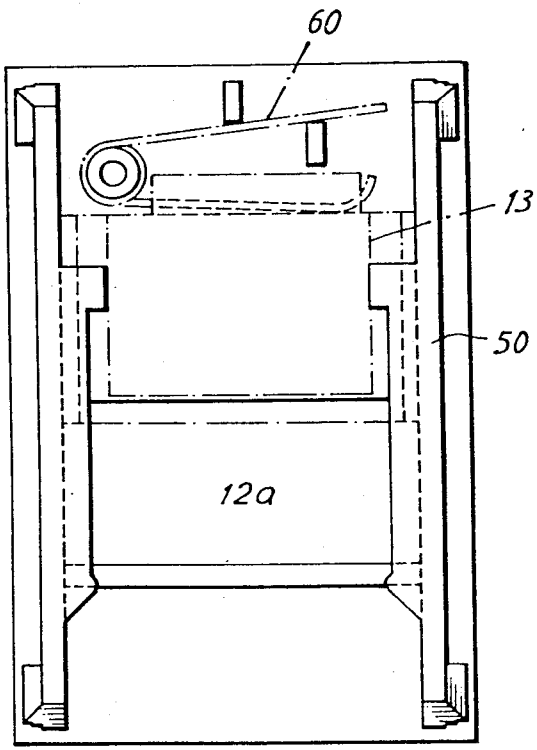
FIG. 6 is a view similar to FIG. 3 with the shutter in its open position.

The shutter 13 slides between the rear of the front plate 12 and the front of the socket 11 between two positions shown in FIGS. 3 and 6, where the shutter 13 is illustrated in chain-dotted lines in its lower (closed) and upper (open) positions respectively. When closed a lip 56 on the lower egdge of the shutter protrudes through the aperture 12*a* as shown in FIG. 5. A jack plug slid upwardly on the lead-in slide 58 on the front plate 12 carries the shutter upwardly with it by engagement of the lip 56 to open the shutter. The shutter 13 slides in a channel defined between the two flanges 14, and is biased downwardly by a spring 60. The spring 60 is wound around a post 62. One end of the spring is captured between two abutments 64, 66 and the other end slides in a groove 68 in the top of the shutter 13.

Thus the shutter is accommodated at the rear of the face plate 12 and is an integral part of the module 10. To this end the face plate extends sufficiently above the top of the aperture 12*a* to accommodate the slide in its raised position, see FIG. 6. The rectangular shape of the module 10 assists in this.

Figure 7A:
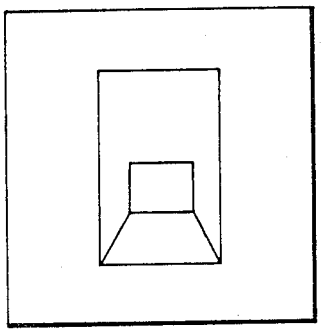
Figure 7B:
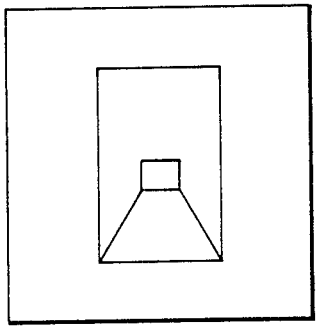
Figure 7C:
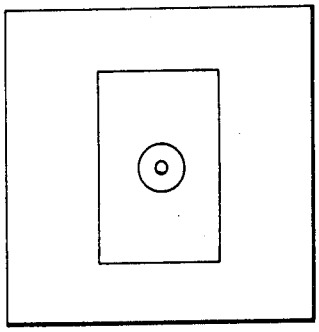
Figure 7D:
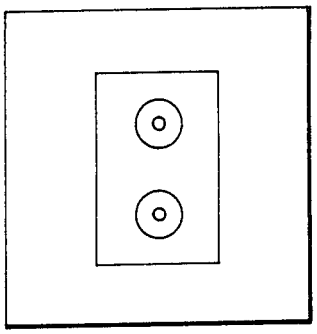
Figure 7E:
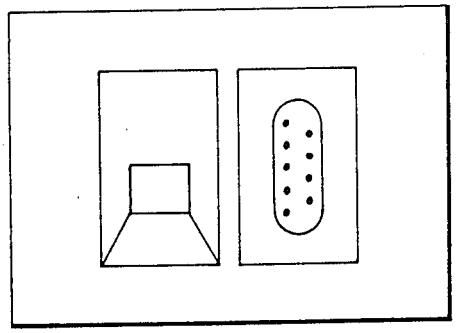

FIGS. 7*a* to 7*e* show front elevational views of six different fascia assemblies embodying the invention. FIG. 7*a* shows an assembly of a fascia and module carrying a shuttered socket for a British Telecom line jack telephone. In FIG. 7*b*, the module shown carries a shuttered socket for Western Electric 4/6 wire line jack telephone. FIGS. 7*c* and 7*d* show assemblies in which the modules carry single and duplex coaxial cable connectors respectively. Finally, FIG. 7*e* shows a fascia assembly having two apertures. In one of the apertures is located a connection module carrying a shuttered socket for a line jack telephone and in the other aperture is located a module carrying a 9 position D-connector.

FIGS. 7*a* to 7*e* demonstrate the versatility of a fascia assembly according to the invention in assembling the different types of junction box which are now required to deal with line jack telephones and associated equipment such as telephone answering machines and electronic information systems which rely on the telecommunications network for the transmission of data.

Figure 8:
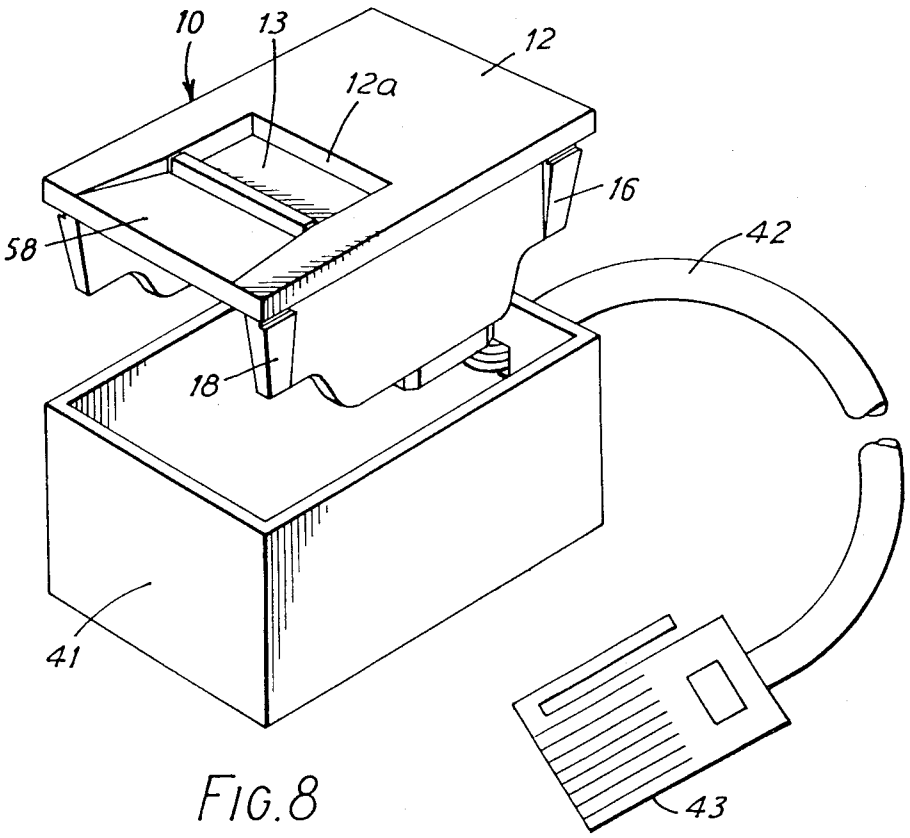
FIG. 8 shows an exploded perspective view of an electrical junction box incorporating the connection module of FIG. 1.

FIG. 8 shows an extension cord connection for a line jack telephone consisting of a box or housing 41 in which may be releasably located the connection module 10 of FIG. 1. The socket 11 (not shown in this figure) is connected to cabling in a cord 42 which terminates in a jack plug 43. This jack plug would, in use, be inserted into the connection module of a fixed junction box. This is one example of how the module can be housed in different housings. It can also be fitted in appropriate apertures in furniture such as desk units or display stands or room dividers or the like. A common module can be received in all such apertures.

I claim:

1. A fascia assembly for an electrical junction housing which assembly comprises a fascia having a front face, a rear face and an aperture extending between said faces and a connection module having a front plate carrying resilient location means co-operating with the edges of the aperture to releasably locate the module in the aperture, the fascia having a formation in contact with the rear face and extending around the aperture against which the rear of the front plate bears such that the front face of the front plate is flush with the front face of the fascia.

2. An assembly as claimed in claim 1, wherein the connection module and location means are moulded integrally from a plastic material.

3. An assembly as claimed in claim 1, wherein the connection module comprises a shuttered socket for a telephone jack plug.

4. An assembly as claimed in claim 1, wherein the fascia has a plurality of apertures therein, which assembly comprises a plurality of connection modules.

5. An assembly according to claim 1, wherein the front plate is provided with a shutter slidable on the rear thereof between open and closed positions.

6. An assembly as claimed in claim 1, wherein said formation comprises bearing plates extending along edges of said aperture.

7. An assembly as claimed in claim 1, wherein the front face of the fascia substantially fills said aperture.

8. An assembly as claimed in claim 1 wherein the connection module is generally rectangular and the resilient location means comprises two flanges one along each of two opposed edges of the module, the flanges being adapted to co-operate with respective edges of the aperture in the fascia.

9. An assembly as claimed in claim 8, wherein said flanges are flexible such that said connector module can be mounted on said fascia by insertion into said aperture from the front of said fascia.

10. An assembly as claimed in claim 9, wherein said flanges comprise upper and lower sections which are spaced from said front plate and a central section which is connected to said front plate.

11. An assembly as claimed in claim 10, wherein said resilient location means further comprises generally wedge-shaped projections extending from upper and lower sections of each flange.

12. An assembly as claimed in claim 11, including a grooved base on each of said flanges, said grooves being in engagement with said formation.

13. An assembly as claimed in claim 12, wherein said formation comprises bearing plates extending along edges of said aperture.

14. An electrical connection module for mounting in an opening in a housing member and having a substantially rectangular front plate with resilient location means on the rear thereof adapted to co-operate with the edges of the opening to releasably locate the module in the opening, said location means comprising flexible flanges, said flanges being located such that the front plate is adapted to be flush with the surface of the housing bearing said opening when said module is mounted therein, the front plate having a shuttered aperture with the shutter slidable on the rear of the front plate between open and closed positions.

15. Apparatus according to claim 14 wherein the shutter is spring-loaded.

16. Apparatus according to claim 15, wherein the resilient location means comprises two flanges one to each side of the aperture extending parallel to the direction of sliding of the shutter.

* * * * *